US010399732B2

(12) United States Patent
Stahlecker

(10) Patent No.: US 10,399,732 B2
(45) Date of Patent: Sep. 3, 2019

(54) PAPER CUP, AND METHOD AND DEVICE FOR MAKING A PAPER CUP

(75) Inventor: Werner Stahlecker, Goeppingen (DE)

(73) Assignee: PTM PACKAGING TOOLS MACHINERY PTE. LTD., Singapore (SG)

( * ) Notice: Subject to any disclaimer, the term of this patent is extended or adjusted under 35 U.S.C. 154(b) by 2323 days.

(21) Appl. No.: 12/653,833

(22) Filed: Dec. 18, 2009

(65) Prior Publication Data

US 2010/0155461 A1 Jun. 24, 2010

(30) Foreign Application Priority Data

Dec. 22, 2008 (DE) ..... 10 2008 064 507

(51) Int. Cl.

| | |
|---|---|
| ***B65D 3/02*** | (2006.01) |
| ***B65D 3/14*** | (2006.01) |
| ***B31F 1/00*** | (2006.01) |
| ***B65D 3/06*** | (2006.01) |
| ***B65D 3/28*** | (2006.01) |
| *B31B 50/25* | (2017.01) |
| *B31B 50/28* | (2017.01) |
| *B31B 50/81* | (2017.01) |

(Continued)

(52) U.S. Cl.

CPC ..... *B65D 3/14* (2013.01); *B31F 1/0038* (2013.01); *B65D 3/06* (2013.01); *B65D 3/28* (2013.01); *B31B 50/25* (2017.08); *B31B 50/28* (2017.08); *B31B 50/81* (2017.08); *B31B 2105/00* (2017.08); *B31B 2105/0022* (2017.08); *B31B 2120/002* (2017.08)

(58) Field of Classification Search

USPC ..... 229/400, 403, 404, 405, 402; 493/152, 493/158

See application file for complete search history.

(56) References Cited

U.S. PATENT DOCUMENTS

| | | | | |
|---|---|---|---|---|
| 1,969,030 A | | 8/1934 | Page | |
| 2,272,920 A | * | 2/1942 | Merta | B29C 51/26 229/400 |
| 3,215,325 A | * | 11/1965 | Shappell et al. | 229/400 |

(Continued)

FOREIGN PATENT DOCUMENTS

| | | |
|---|---|---|
| CN | 2170695 | 7/1994 |
| CN | 201124595 | 10/2008 |

(Continued)

OTHER PUBLICATIONS 2 pages from www.cupmachine.net/paper-cup-forming-machine, May 18, 2011.

(Continued)

*Primary Examiner* — Christopher R Demeree
(74) *Attorney, Agent, or Firm* — Flynn Thiel, P.C.

(57) ABSTRACT

1. Paper cup, and method and device for making a paper cup.
2.1. The invention relates to a paper cup with a cup sleeve and a bottom connected in a liquid-tight manner to the cup sleeve.
2.2. In accordance with the invention, the cup sleeve is arranged between the bottom and an end opposite the bottom at least in some sections at an angle greater than or equal to 10°, in particular between 10° and 15°, relative to a central longitudinal axis of the paper cup.
2.3. Use for example for paper cups of plastic-coated paper material.

16 Claims, 6 Drawing Sheets

(51) Int. Cl.

| | |
|---|---|
| *B31B 105/00* | (2017.01) |
| *B31B 120/00* | (2017.01) |

(56) References Cited

U.S. PATENT DOCUMENTS

| | | | | |
|---|---|---|---|---|
| 6,142,331 | A * | 11/2000 | Breining et al. | 220/62.12 |
| 7,451,910 | B2 | 11/2008 | Frost et al. | |
| 7,703,664 | B2 * | 4/2010 | Westphal et al. | 229/4.5 |
| 2002/0043555 | A1 | 4/2002 | Mader | |
| 2002/0111260 | A1 | 8/2002 | Sand | |
| 2003/0183681 | A1 | 10/2003 | Liou | |
| 2006/0289609 | A1 * | 12/2006 | Fritz et al. | 229/4.5 |
| 2007/0281844 | A1 * | 12/2007 | Shulba | 493/158 |
| 2008/0023537 | A1 | 1/2008 | Frost et al. | |
| 2008/0280743 | A1 | 11/2008 | Stahlecker et al. | |

FOREIGN PATENT DOCUMENTS

| | | | |
|---|---|---|---|
| CN | 101301798 | | 11/2008 |
| DE | 10 2007 024 243 | A1 | 1/2008 |
| DE | 10 2007 030 864 | A1 | 1/2008 |
| EP | 0 695 692 | A2 | 2/1996 |
| FR | 2 397 332 | | 2/1979 |
| GB | 2 055 038 | A | 2/1981 |
| JP | 34312/81 | * | 4/1981 |
| JP | 144744/82 | * | 9/1982 |
| JP | 106491/90 | * | 5/1992 |
| JP | 09-277407 | | 10/1997 |
| JP | 2000-238739 | | 9/2000 |
| JP | 2001-192015 | A | 7/2001 |
| JP | 2001-233318 | | 8/2001 |
| JP | 2002-037233 | | 2/2002 |
| JP | 2003-112717 | | 4/2003 |
| JP | 2003-276720 | | 10/2003 |
| JP | 2005-263295 | | 9/2005 |

OTHER PUBLICATIONS

European Search Report dated Jun. 30, 2011 for corresponding European Application No. EP 09-01-5173.

Chinese Office Action dated Dec. 6, 2012 (3 pages).

English Translation of Office Action from the JPO for Application No. JP 2009-289904 dated Sep. 11, 2013 (5 pages).

Office Action of European Patent Office issued in Application No. 09 015 173.9 dated Feb. 24, 2017 (5 pages).

* cited by examiner

PAPER CUP, AND METHOD AND DEVICE FOR MAKING A PAPER CUP

FIELD OF THE INVENTION

The invention relates to a paper cup with a cup sleeve and a bottom connected in a liquid-tight manner to the cup sleeve.

BACKGROUND OF THE INVENTION

Known paper cups are made from paper segments wound using a folding mandrel into a frustum shape. By shaping of a top curl on the top edge of the frustum-shaped cup sleeve and by inserting a bottom into the cup sleeve, a paper cup for receiving liquids is provided. If hot beverages are to be received, the paper cup can be additionally provided with an insulating outer envelope. During shaping of the top curl and also during connection of the bottom to the cup sleeve at an all-round bottom edge, the paper material of the cup sleeve must be curled or folded round by at least 180°. To do so, the paper material must be compressed in the area of the bottom edge, and partly stretched and partly compressed in the area of the top curl. Compressing leads to an excess of paper material and hence to a more or less rippled surface. This can be accepted on an inside of the bottom edge, but a rippled surface cannot be accepted at the top curl. As a result, numerous measures must be taken in the area of the top curl in order to make a top curl with a smooth surface. The compressing or stretching of the paper material during curling or folding round is all the greater as the cone angle of the cup sleeve increases. Using the example of the top curl, the upper rim of the cup sleeve in the case of a cylindrical tube is stretched during curling, as soon as it has been curled by 360° and hence substantially is back in its initial position, but there is no substantial material stretching or material compression. This is not the case with frustum-shaped sleeves, since the upper rim of the cup sleeve is moved during provision of the top curl into a position in which a smaller diameter is obtained in comparison with the original diameter of the upper rim. After a curling process of the upper rim by 360° too, the paper material of the upper rim must therefore be able to sustain a permanent material compression without creasing. The greater the cone angle of the cup sleeve, the greater this diameter difference is and the greater is the tendency during creation of the top curl and during creation of the bottom edge to crease. For this reason, conventional paper cups are made with a cone angle of the cup sleeve of 9° at most.

SUMMARY OF INVENTION

The invention is intended to provide a paper cup which is suitable not only for receiving liquids, but also for receiving and for consumption of foods, for example soups.

In accordance with the invention, a paper cup with a cup sleeve and a bottom connected to the cup sleeve in a liquid-tight manner is provided, in which the cup sleeve is arranged between the bottom and an end opposite the bottom at least in some sections at an angle greater than or equal to 10°, in particular between 10° and 15° or between 10° and 25°, relative to a central longitudinal axis of the paper cup.

By providing a larger cone angle of the cup sleeve, a bowl-like paper cup is obtained that is well suited in particular for receiving soups or other food. The substantial feature here is the flatter side wall of the paper cup in accordance with the invention when compared with conventional paper cups, considerably facilitating the consumption of food out of the paper cup. Not least, it is possible thanks to the wider opening angle of the paper cup to provide a comparatively wide cup opening without the capacity of the paper cup becoming excessively large. This too facilitates the consumption of food directly from the paper cup in accordance with the invention, since for example the cup opening is large enough to move a spoon inside the cup's volume.

In an embodiment of the invention, the cup sleeve is connected in liquid-tight manner by an all-round edge to the bottom, where the edge is arranged parallel to a central longitudinal axis or is designed flaring from the bottom to the end of the edge.

With an embodiment of this type for a bottom edge, firstly an attractive bowl-like appearance of the paper cup in accordance with the invention is achieved, since the cylindrical or inverse-conical design of the edge has the optical effect of a kind of base, and furthermore the standing surface is enlarged compared with a strictly frustum shaped design of the paper cup.

In an embodiment of the invention, a top curl is shaped on an upper rim, opposite the bottom, of the cup sleeve.

A cup with top curl can be brought up to the mouth without problems and is pleasant to use. Furthermore, the upper rim of the cup sleeve is substantially stabilized by the top curl. This is of particular importance for paper cups with large diameter.

In an embodiment of the invention, the cup sleeve is, between the bottom and an end opposite the bottom, curved outwards at least in some sections when viewed from the interior of the cup.

In this way the cup is provided with a very attractive and bowl-like shape. Furthermore, it is possible thanks to the outward-curving cup sleeve to obtain a cup shape very well suited for eating using a spoon, for example.

In an embodiment of the invention, the cup sleeve is, between the bottom and an end opposite the bottom, curved inwards at least in some sections when viewed from the interior of the cup.

With this concave design of the cup sleeve, a shape very easily gripped and held by the human hand is obtained despite its wide opening. Furthermore, the volume of such a paper cup with concave cup sleeve can be kept small despite the wide opening.

In an embodiment of the invention, a wall of the cup sleeve is designed with S-shaped cross-section, so that the cup sleeve is, in the area of the bottom and in the area of its end opposite the bottom, at a lower angle relative to the central longitudinal axis than in a central section.

Thanks to an S-shaped design like this of the cup sleeve, shaping of a top curl and of a bottom edge is considerably facilitated, because despite the angle greater than or equal to 10° in a central section of the cup sleeve, an angle of less than 10°, for example, applies in the area of the bottom and in the area of the upper rim, and in any event a lower angle than in the middle, so that a top curl and an edge can be shaped without any problem and without having to fear any excessive rippling or tearing of the paper material. Nevertheless, the bowl-like impression of the paper cup is retained.

In an embodiment of the invention, the cup sleeve is connected in liquid-tight manner to the bottom by means of an all-round edge, where the edge is formed by folding a lower rim area of the cup sleeve around a bottom rim, or a lower rim area of the bottom around the lower rim of the cup sleeve, where the lower rim area of the cup sleeve or the lower rim area of the bottom is provided with notches out of the paper material.

Thanks to notches out of the paper material, the upper and lower rim of the cup sleeve can be shaped substantially more easily and in particular tearing of the paper material or excessive rippling are avoided.

In an embodiment of the invention, the notches extend from the rim of the bottom or from the rim of the cup sleeve to no more than half the height of the edge.

In this way, the shaping of the bottom edge can be substantially facilitated without its dependably liquid-tight design being endangered, because up to half the height of the edge the folded-over paper material is in full-surface contact with the rim of the bottom or with the rim of the cup sleeve, so that an all-round and continuous seal can be achieved.

In an embodiment of the invention, the cup sleeve is provided with an all-round recess projecting into the interior of the cup, and a lower rim of the edge is dimensioned such that an outer circumference of the lower rim of the edge is smaller than or equal in size to a larger diameter at the recess and larger than a smaller diameter at the recess.

With a design of this type for the edge and for the recess, the edge can rest on the recess when several cups are stacked. Several cups can be stacked as a result without the bottom edge of the top cup sticking in the lower cup. Thanks to the wide angle that the cup sleeve takes at least in some sections relative to the central longitudinal axis, the cup sleeves of several stacked cups are then no longer in contact with one another, so that no sticking need be feared even when numerous paper cups are stacked.

In an embodiment of the invention, the cup is designed at least in some sections with double walls.

In this way, an insulating cup can be provided in which even very hot foods such as noodle soup can be received without problem and nevertheless held without any risk to the hand of the user.

The problem underlying the present invention is also solved by a method for making a paper cup with a cup sleeve and a bottom, where the cup sleeve has a top curl shaped at an end of the cup sleeve opposite the bottom, where the cup sleeve is arranged between the bottom and an end opposite the bottom at least in some sections at an angle greater than or equal to 10°, in particular between 10° and 15°, relative to a central longitudinal axis of the paper cup.

In an embodiment of the invention, the top curl is formed in at least two curling steps, where the cup sleeve is clamped in different ways during the curling steps at least partially by holding devices.

Surprisingly, it has proved that despite the wide angle greater than or equal to 10° which the cup sleeve takes at least in some sections relative to the central longitudinal axis, the shaping of a top curl is possible by splitting the forming of the top curl into at least two curling steps and in addition clamping the cup sleeve in different ways during the different curling steps. The aim is to prevent the buckling of the cup wall during the curling steps such that the cup sleeve is clamped during the different curling steps in each case just below the upper rim of the cup sleeve or the already partially completed top curl. Thanks to this repeated clamping, the top curl can be dependably shaped without any fear of bulging or buckling of the cup sleeve.

In an embodiment of the invention, four curling steps are provided for shaping the top curl. Advantageously a curl of at most 180° is provided in each curling step. It can also be provided that in a first curling step a curl of 180° and in subsequent curling steps a curl of about 90° is provided. A split of this type into four curling steps and into a first curl of about 180° and subsequent curls of about 90° permits process-reliable shaping of a top curl even with very wide angles between the central longitudinal axis and the cup sleeve of more than 10° and even up to an angle of 15°.

In an embodiment of the invention, the steps provided are picking up the cup sleeve in a holding ring, moving a holding punch into the cup sleeve, clamping the cup sleeve between the holding ring and the holding punch, and applying a curling tool to the upper rim of the cup sleeve.

At least partly differing curling tools and at least partly differing holding tools can be used here. The use of one and the same holding ring, but differing holding punches and curling tools, is advantageous. If necessary the formed top curl can be pressed flat too in order to provide a sealing surface for attachment of a diaphragm closing the cup.

The problem underlying the invention is also solved by a device for making a paper cup with a cup sleeve and a bottom where the cup sleeve has a top curl shaped on an end of the cup sleeve opposite the bottom, where means for arranging the cup sleeve between the bottom and an end opposite the bottom are provided at least in some sections at an angle greater than or equal to 10°, in particular between 10° and 15°, relative to a central longitudinal axis of the paper cup.

In an embodiment of the invention, means are provided for infeed of at least one curling tool for forming of the top curl at least in some sections on the upper rim of the cup sleeve, where an infeed direction is approximately parallel to a section of the upper rim area of the cup sleeve to be processed by the curling tool.

Since an infeed direction of the curling tool is approximately parallel to the material of the cup sleeve, buckling or bulging of the cup sleeve during forming of the top curl can be avoided, since the paper material is very stable against a thrust load approximately parallel to the material of the cup sleeve, so that even high pressure forces can be applied to the sleeve during forming of the top curl.

In an embodiment of the invention, the curling tool is split over the upper circumference of the cup sleeve into several segments which are each arranged movably parallel to a section of the upper rim area of the cup sleeve to be processed by the respective segment.

By means of this splitting of the curling tool into several segments, the achievable result is a variable diameter of the curling tool during infeed. This is particularly useful in particular for wide angles of the cup sleeve of more than 10° relative to the central longitudinal axis, in order to ensure an infeed direction of the curling tool that is approximately parallel to the material of the cup sleeve.

Further features and advantages of the invention can be found in the claims and the following description of preferred embodiments of the invention in conjunction with the drawings. Individual features of the various embodiments can here be combined with one another as required without going beyond the scope of the invention.

DETAILED DESCRIPTION

Figure 1:
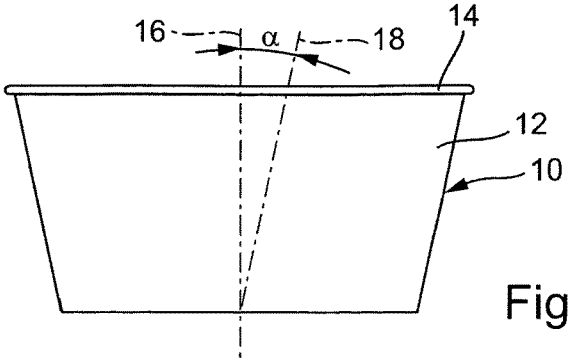
FIG. 1 is a side view of a first embodiment of a paper cup in accordance with the invention.

The view of FIG. 1 shows a side view of a first paper cup 10 in accordance with the invention. This paper cup 10 has a frustum-shaped cup sleeve 12 on whose upper end in FIG. 1 a top curl 14 is shaped. At its end which is lower in FIG. 1, the paper cup 10 is provided with a bottom, not visible, which is connected in the area of a likewise not visible bottom edge to the cup sleeve 12. The cup sleeve 12 has an angle $\alpha$ of approximately 11° to a central longitudinal axis 16 of the cup. This angle $\alpha$ is drawn in the illustration in FIG. 1 between the central longitudinal axis 16 indicated by a dash-dotted line and a dashed line 18 having the same inclination as the cup wall drawn on the right in FIG. 1.

Figure 2:
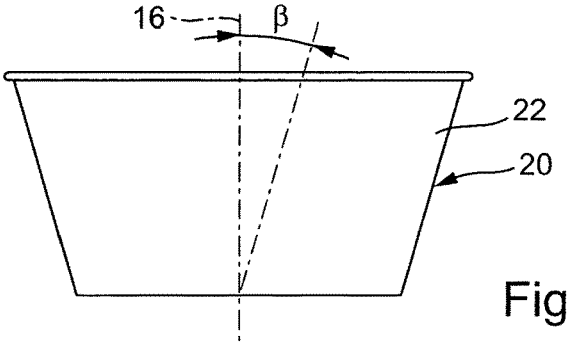
FIG. 2 is a side view of a second embodiment of a paper cup in accordance with the invention.

The illustration in FIG. 2 shows a further paper cup 20 in accordance with the invention that differs from the paper cup shown in FIG. 1 only in the inclination of the wall of a cup sleeve 22 to the central longitudinal axis 16. In the paper cup 20 too, the cup sleeve 22 has a frustum shape and a top curl shaped on its top rim. A cone angle $\beta$ of the cup sleeve 22 is approximately 15°.

A cone angle of the cup sleeves 12, 22 is greater than or equal to 10°, for example 11° in the paper cup 10 or 15° in the paper cup 20, and ensures a bowl-like appearance of the paper cups 10, 20 and also that a comparatively wide opening surrounded by the respective top curls 14 of the paper cups 10, 20 can nevertheless be provided with a low volume. In addition, the comparative obliquely running inner wall of the cup sleeve contributes to allowing food to be eaten from the paper cups 10, 20 using a spoon without problems. The wide opening and the wide angle $\alpha$, $\beta$ between the cup wall and the central longitudinal axis 16 facilitates the eating of food from the paper cups 12, 20 using a spoon. The paper cups 10, 20 are therefore especially suitable for food, for example liquid food such as noodle soup or the like.

Figure 3:
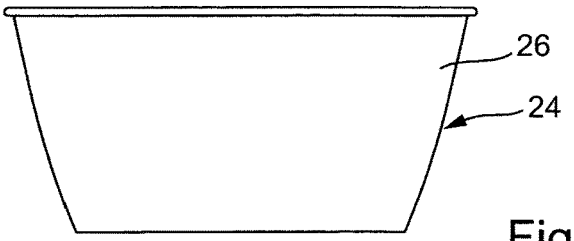
FIG. 3 is a side view of a third embodiment of a paper cup in accordance with the invention.

The illustration in FIG. 3 shows a further paper cup 24 in accordance with the invention. As can be discerned, the paper cup 24 has a cup sleeve 26 of convex design and accordingly bulging outwards from its interior. With a convex design of this type, a very attractive and bowl-like form is obtained.

Figure 4:
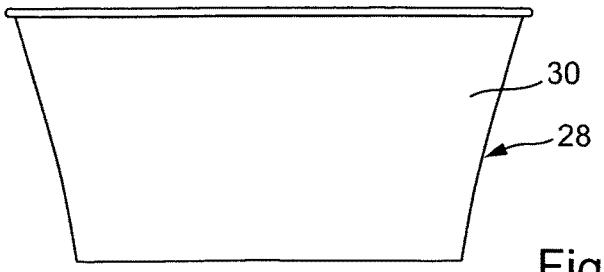
FIG. 4 illustrates a fourth embodiment of a paper cup in accordance with the invention.

The illustration in FIG. 4 shows a further paper cup 28 in accordance with the invention whose cup sleeve 30 is designed concave. The cup sleeve 30 is thus designed curving inwards to its interior. A concave cup sleeve 30 of this type can be held particularly easily and comfortably in the hand.

Figure 5:
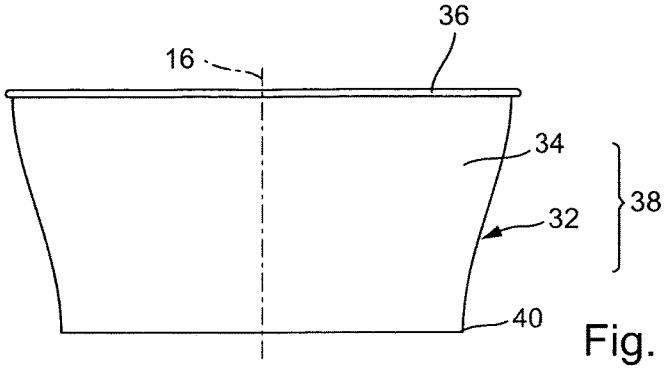
FIG. 5 illustrates a fifth embodiment of a paper cup in accordance with the invention.

The illustration in FIG. 5 shows a further paper cup 32 in accordance with the invention whose cup sleeve 34 has a wall with a cross-section of S-like shape. As can be discerned, an angle taken by the cup sleeve relative to the central longitudinal axis 16 just underneath a top curl 36 is smaller than an angle taken by the cup sleeve relative to the central longitudinal axis 16 in a central area 38 between a bottom edge 40 and the top curl 36. In any event, the angle taken by the cup sleeve 34 in the central area 38 relative to the central longitudinal axis 16 is greater than or equal to 10° and in the embodiment shown of the paper cup 32 this angle is around 15°. In an area of the cup sleeve 34 which is underneath the area 38 and hence directly above and below a bottom, the cup sleeve 34 takes relative to the central longitudinal axis 16 once again a smaller angle than in the area 38. This results, in a longitudinal section where the section plane contains the central longitudinal axis 16 or when viewing the silhouette of the paper cup 32, in an S-shaped rim of the cup sleeve 34. When viewing the wall on the right of the central axis 16 in FIG. 5, the cup sleeve 34 runs, starting from the top curl 36, first with a mathematically negative curvature, i.e. curved in the clockwise direction, or in general curved outwards or convex when viewed from the central longitudinal axis 16. At half the height of the paper cup 32 and approximately in the middle of the area 38, the curvature of the cup sleeve 34 reverses its course and then runs, when viewing the right-hand wall in FIG. 5 down to the bottom rim of the paper cup 32, in the mathematically positive sense, i.e. curved counter-clockwise or in general curved inwards or concave when viewed from the central longitudinal axis 16.

Besides a visually very attractive bowl form of the paper cup 32, it is achieved by this S-shape of the cup sleeve that in those areas in which the top curl 36 or the bottom edge 40 are shaped an angle taken by the cup sleeve 34 relative to the central longitudinal axis 16 is smaller than in the middle area 38. As a result, the shaping of the top curl and the shaping of the bottom edge 40 are considerably facilitated, since with an increasing angle of the cup sleeve 34 relative to the central longitudinal axis 16 the paper material of the cup sleeve 34 must be more severely stretched or compressed and hence the danger of tearing or rippling increases. Thanks to the S-shape of the cup sleeve 34 of the paper cup 32, the visual impression of a bowl-like cup with a flat cup wall is achieved as a result, and nevertheless both the top curl 36 and the bottom 40 can be shaped without fear of increased rippling or even tearing of the paper material.

Figure 6:
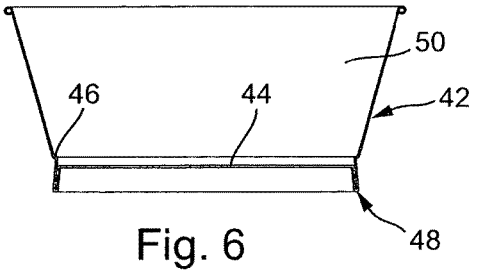
FIG. 6 is a sectional view of a sixth embodiment of a paper cup in accordance with the invention.

The illustration of FIG. 6 shows a further paper cup 42 in accordance with the invention in a section. The paper cup 42 has an inwardly projecting all-round recess 46 just above a bottom 44. In addition, the paper cup 42 is provided with a bottom edge 48 which is designed inversely conical to the rest of the paper cup 42. In fact a cup sleeve 50 has up to the all-round recess 46 a frustum form tapering downwards towards the bottom 44. From the all-round recess 46 to the level of the bottom 44, the cup sleeve is designed cylindrical in order to dependably transfer stacking forces. From the bottom 44, the cup sleeve 50 then has a conical form widening in the downward direction. As a result, the bottom edge 48 too has a form widening from the bottom 44 to the lower rim of the edge 48 which is at the same time the lowest rim of the cup 42. An outer circumference of the lower rim of the bottom edge 48 is here slightly smaller than the larger diameter of the all-round recess 46. The outer diameter of the bottom edge 48 is at the same time smaller than the smaller diameter of the all-round recess 46, so that dependable destacking is possible with the bottom edge 48.

Figure 8:
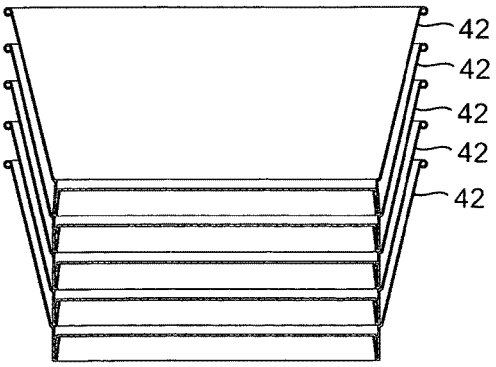
FIG. 8 is a sectional view of several paper cups in accordance with FIG. 6 stacked one inside the other.
Figure 9:
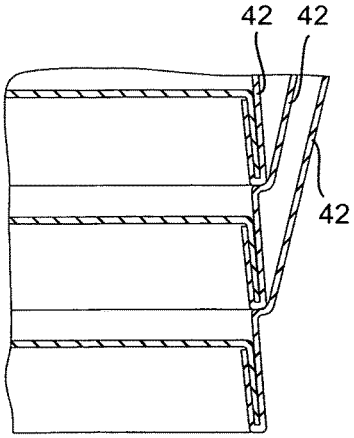
FIG. 9 is an enlarged view of a section of the paper cup of FIG. 8.

As shown in FIGS. 8 and 9, several paper cups 42 can as a result be stacked inside one another, where in each case the bottom edge 48 of the upper cup rests on the all-round recess 46 of the cup below it. It can be discerned in FIGS. 8 and 9 that the cup walls of the cups stacked inside one another are not touching. As a result, numerous cups 42 can be stacked without fear of the stacked cups sticking together.

Even numerous stacked cups 42 can therefore be separated again without problems.

Figure 7:
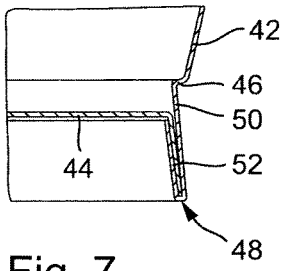
FIG. 7 is an enlarged view of a section of the bottom rim of the paper cup of FIG. 6.

As can be seen in the illustration in FIG. 7, the structure of the bottom edge 48 can be discerned more precisely. The bottom 44 has an all-round bottom rim 52 bent approximately 90° downwards. The cup sleeve 50 is folded around by 180° with its lower rim and thus forms a pocket inside which the all-round bottom rim 52 is almost completely received. The cup sleeve 50 thus contacts both the outside and the inside of the all-round bottom rim 52. The bottom rim 52 and those areas of the cup sleeve 50 in contact with it are thermally fused with one another or glued in order to ensure a liquid-tight connection of the bottom 44 to the cup sleeve 50.

Figure 10:
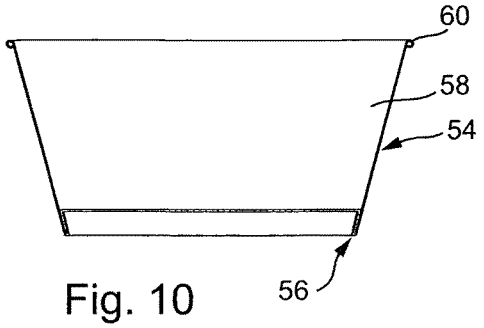
FIG. 10 is a sectional view of a seventh embodiment of a paper cup in accordance with the invention.

The illustration in FIG. 10 shows a further paper cup 54 in accordance with the invention in section. In the paper cup 54, a bottom edge 56 is at the same angle relative to a central longitudinal axis of the paper cup 54 as the cup sleeve 58. The paper cup 54 therefore shows in the section in FIG. 10 a strict trapezoid, with the exception of a top curl 60.

Figure 11:
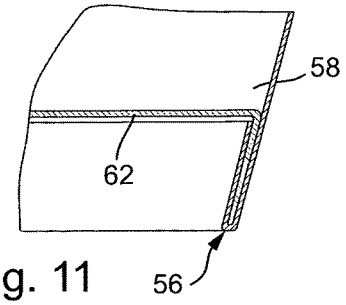
FIG. 11 is an enlarged view of a section of the paper cup of FIG. 10.

In the illustration in FIG. 11, the structure of the bottom edge 56 is shown enlarged. The cup sleeve 58 is folded around by 180° at its lower rim and a bottom rim of a bottom 62 is inserted into the resultant pocket. The paper material layers contacting one another in the area of the bottom edge 56, all of which are plastic-coated at least on one side, are connected to one another in liquid-tight manner by so-called thermal sealing or fusion.

Figure 12:
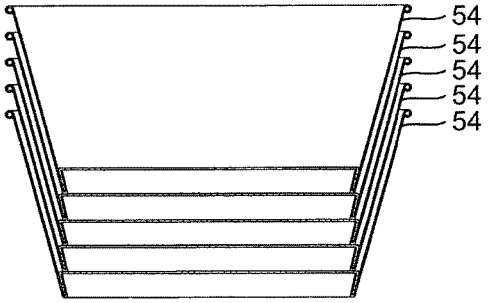
FIG. 12 is a sectional view of several paper cups in accordance with FIG. 10 stacked one inside the other.
Figure 13:
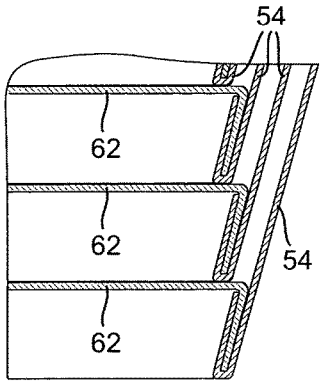
FIG. 13 is an enlarged view of a section from FIG. 12.

The illustration in FIG. 12 shows in section a total of five paper cups 54 stacked one inside the other and the illustration in FIG. 13 shows an enlarged view of a section through the bottom area of these stacked cups. It can be discerned that the lowest cup rim in each case rests on a respective bottom 62 of the cup arranged underneath it. Because of the wide inclination angle between the respective cup sleeve 58 and a central longitudinal axis, the cup sleeves of the stacked cups do not touch. As a result, even numerous stacked cups 54 cannot stick to one another and can be separated without problem.

Figure 14:
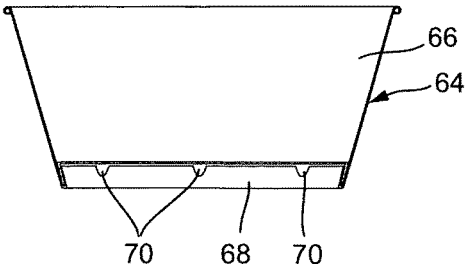
FIG. 14 is a sectional view of an eighth embodiment of a paper cup in accordance with the invention.
Figure 15:
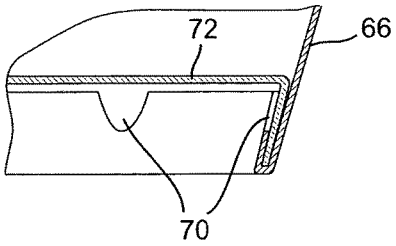
FIG. 15 is an enlarged view of a section from FIG. 14.
Figure 16:
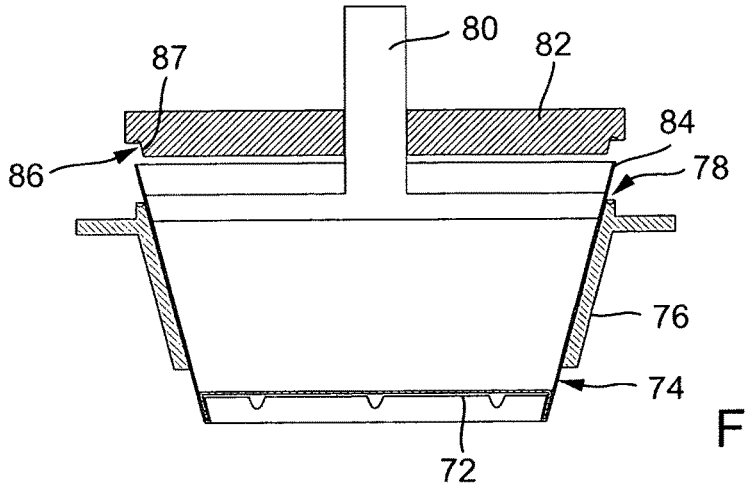
FIG. 16 illustrates a device in accordance with the invention for making a paper cup.

The illustration in FIG. 14 shows in section a further paper cup 64 and FIG. 15 shows an enlarged view of the bottom area of the paper cup 64.

It can be discerned from FIGS. 14 and 15 that a cup sleeve 66 is provided with several so-called notches 70 in its area 68 folded over inwards by 180°. These notches 70 are designed triangular in each case, with one tip of the triangle projecting into the material. These notches 70 facilitate the compression of the material of the cup sleeve 66 during folding over in order to form the bottom edge. In particular the notches 70 can prevent, even in the case of wide angles between the central longitudinal axis and the cup sleeve 66, an excessive rippling or even creasing of the paper material occurring in the area of a bottom edge.

It can however also be discerned that the triangular notches 70 extend only to half the height of the bottom edge. Below the notches 70, therefore, a sufficiently large material section is available for all-round and complete sealing between the cup sleeve 66 and the bottom 72 to ensure a dependably liquid-tight connection of the bottom 72 to the cup sleeve 66.

The illustrations in FIGS. 16 to 20 show several steps in the shaping of a top curl on a cup 74 in accordance with the invention. A device for shaping of a top curl has a holding ring 76 having a frustum-shaped inner surface of which the inclination angle is matched precisely to the inclination angle of the cup sleeve of the paper cup 74. The holding ring 76 has on its upper edge an all-round groove 78 approximately semicircular in cross-section. In order to securely and immovably hold the paper cup 74 already provided with the bottom 72 inside the holding ring 76 during shaping of the top curl, a holding punch 80 is provided that is inserted from above into the cup 74. The holding punch 80 has a disk-like frustum shape which is also matched to the inclination angle of the paper cup 74. The holding punch 80 is provided with a guide rod central to the disk-like frustum. A disk-like first curling tool 82 is guided on this guide rod such that it can be infed, parallel to a central longitudinal axis of the paper cup 74, to the upper rim 84 of the latter. The first curling tool 82 is on its side facing the paper cup 74 provided with an all-round curling groove 86 with approximately semicircular cross-section. Viewed from the paper cup 74, a cone wall 87 moves towards the curling groove 86, where an inclination angle of the cone wall 87 corresponds to the inclination angle of the cup sleeve of the paper cup 74.

Figure 17:
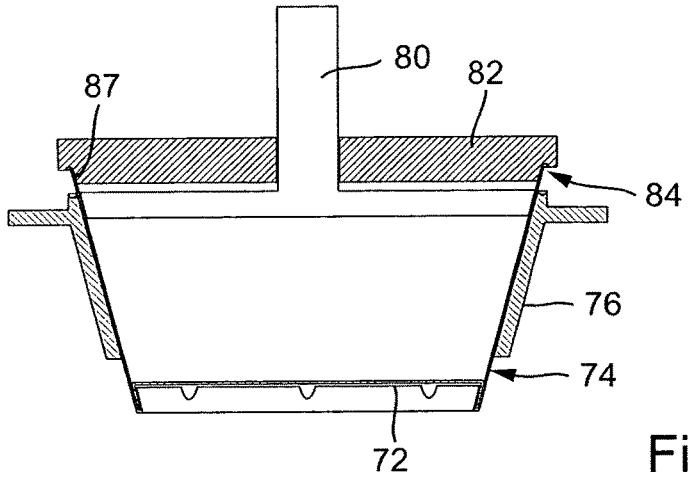
FIG. 17 illustrates the device from FIG. 16 during a first process step.

A first curling step of the upper rim 84 is shown in FIG. 17. The first curling tool 82 was infed so far to the upper rim 84 of the cup 74 that the upper rim 84 in the curling groove 86 of the first curling tool 82 was bent around by approximately 180° and now points downwards in the direction of the cup bottom 72. An evasion of the upper cup rim 84 or of the area of the cup sleeve adjacent thereto is here prevented by the cone wall 87 on the first curling tool 82 moving towards the curling groove 86. In addition, an evasion of the cup sleeve is prevented by the holding punch 80 and the holding ring 76.

Figure 18:
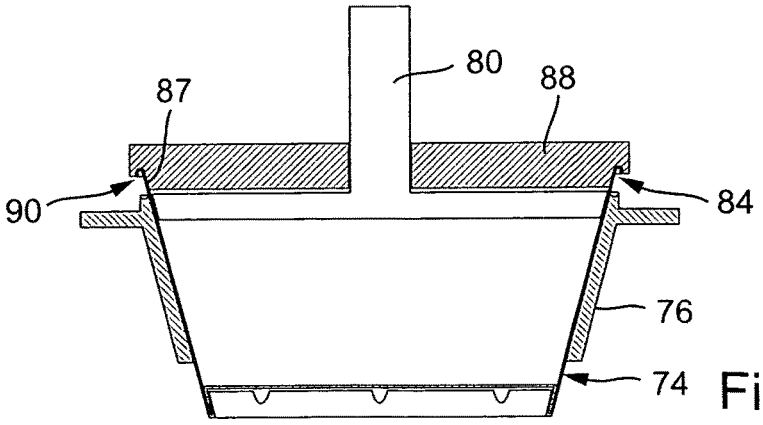
FIG. 18 illustrates the device from FIG. 16 during a second process step.

The illustration in FIG. 18 shows the paper cup 74 after performance of a second curling step with a second curling tool 88. The paper cup 74 is held unchanged during this second curling step too by the holding ring 76 and by the holding punch 80. The second curling tool 88 differs from the first curling tool 82 in its deeper-cut curling groove 90. With the curling groove 90, the upper rim 84 of the paper cup 74 already folded around by approximately 180° is thus folded by approximately a further 90°. The second curling tool 88 too is infed parallel to the central longitudinal axis of the paper cup 84 onto the already partially curled upper rim 84.

Figure 19:
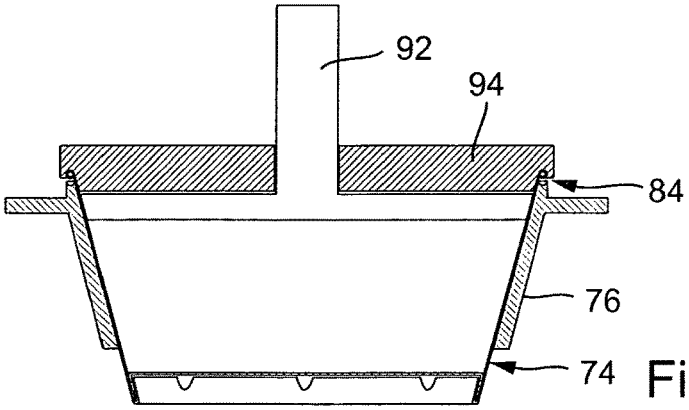
FIG. 19 illustrates the device from FIG. 16 during a third process step.

The illustration in FIG. 19 shows a third curling step for forming the top curl. The paper cup 74 is here held by the holding ring 87, where however a second holding punch 92 with an outer diameter slightly smaller than the first holding punch 80 is used to press the paper cup 74 from inwards against the holding ring 76. Thanks to the smaller diameter of the frustum-shaped disk of the second holding punch 92, the second holding punch 92 is below an upper rim of the holding ring 76 so that a third curling tool 94 can be infed further in the direction of the holding ring 76. It is possible to use the second curling tool 88 again for the third curling step too instead of a third curling tool 94. However, a different holding punch must be used to permit further infeed of the curling tool 94 in the direction of the holding ring 76.

The upper rim 84 of the paper cup 74 is folded around a further 90° by means of the third curling step shown in FIG. 19. After completion of the third curling step, the upper cup rim 84 has hence been folded over by approximately 360°.

Figure 20:
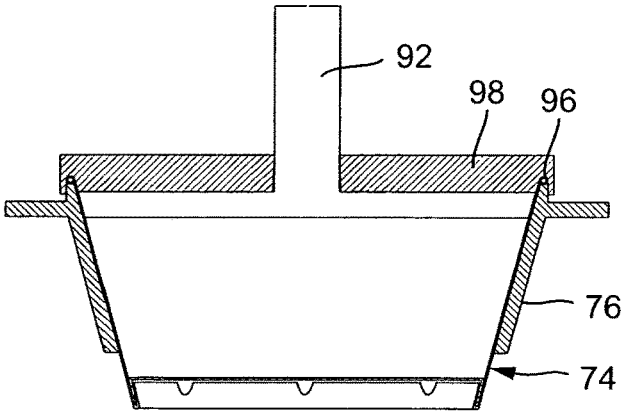
FIG. 20 illustrates the device from FIG. 16 during a fourth process step.

The illustration in FIG. 20 shows the fourth and concluding curling step in which a top curl 96 is completed. To do so, a fourth curling tool 98 is used that is distinguished from the curling tools 82, 88 and 94 by a different design of the curling groove. In the fourth curling step too, the paper cup 74 is however still held by the holding ring 76 and the second holding punch 92. The fourth curling tool 98 is now infed so far towards the upper rim 84 of the paper cup 74 until the top curl is with its lower area inside the all-round groove 78 of the holding ring. The top curl 96 is hence shaped from above by the curling groove of the fourth curling tool 98 and from below by the groove 78 of the holding ring 76.

After completion of the fourth curling step, the top curl 96 is completed on the paper cup 74.

Figure 21:
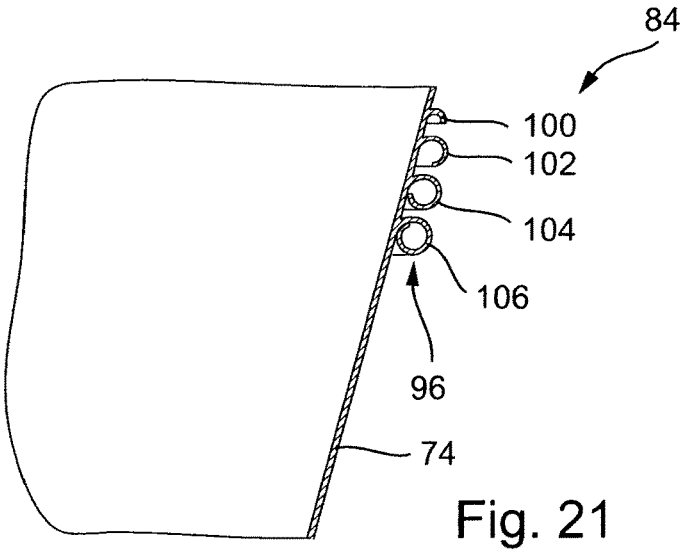
FIG. 21 is a schematic view of a total of four curling steps during shaping of a top curl in accordance with a method in accordance with the invention for making a paper cup.

The illustration in FIG. 21 shows schematically the upper rim 84 of the paper cup 74 during the four individual curling steps. As explained, the upper rim 84 is folded round by approximately 180° after the first curling step in a position 100. After the second curling step, shown in a position 102, the upper rim 84 is folded round by a further 90°. After the third curling step, shown in the position 104, the upper rim 84 is folded round by a further 90° and hence, when seen from its initial position, folded round by approximately 360° overall. After the concluding fourth curling step, in which a further curling operation by 90° takes place, shown in the position 106, the top curl 96 is then completed and shows overall a curl with an angle of approximately 450°.

Thanks to splitting up, in accordance with the invention, the forming of the top curl into several steps, for example four steps, in conjunction with a clamping of the upper area of the cup 74 as close as possible to the upper rim, it is possible despite the wide inclination angle of the cup wall to shape a top curl. Bulging or buckling of the upper cup area is here prevented by the variable clamping of the cup 74, matched to the respective curling tool, and the splitting up into individual curling steps, at least partly using different curling tools.

Figure 22:
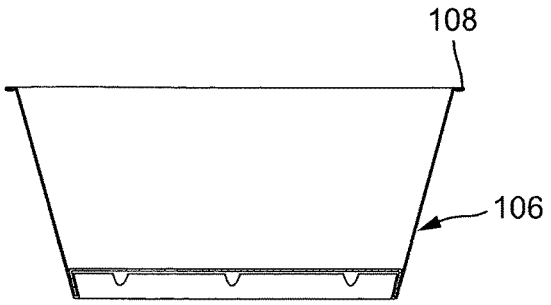
FIG. 22 is a sectional view of a paper cup in accordance with the invention in accordance with a ninth embodiment.
Figure 23:
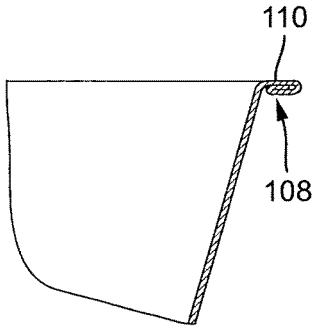
FIG. 23 is an enlarged view of a section of the paper cup of FIG. 22.

The illustration in FIG. 22 shows a further paper cup 106 in accordance with the invention. Unlike the paper cup 64 in FIG. 14, in the paper cup 106 a top curl 108 is pressed flat after conclusion of the fourth curling step. This can also be readily discerned in the illustration enlarged of a section in FIG. 23. In addition to pressing flat of the top curl 108, the individual layers of the top curl 108 are thermally sealed to one another. After pressing flat and sealing, an all-round surface 110 is thus provided at the top of the cup to which for example a diaphragm for closing the cup opening can be fused or glued.

Figure 24:
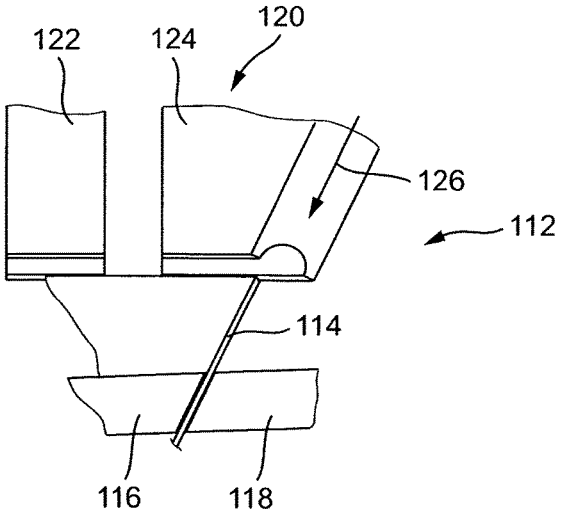
FIG. 24 is a schematic view of a section of a further embodiment of a device in accordance with the invention for making a paper cup.

The illustration in FIG. 24 shows in schematic form a device 112 for shaping a top curl on a paper cup 114 in accordance with the invention, which is likewise shown only in some sections in its upper rim area. The paper cup 114 is held just below its upper rim by a holding punch 116 only indicated and by a likewise only indicated holding ring 118. A curling tool 120 has several segments 122, 124 which on their side facing the upper rim of the paper cup 114 are each provided with a groove semicircular in cross-section. The segments 122, 124 are each intended to curl only one section of the upper rim of the paper cup 114. Thanks to the splitting up of the curling tool 120 into segments, it is however possible to infeed the individual segments 122, 124 in each case parallel to the inclination of the wall of the paper cup 114. Using the example of segment 124, this is shown by the arrow 126, symbolizing an infeed direction of the segment 124 towards the paper cup 114. Parallel to its cup wall, the paper material of the paper cup 114 has a comparatively high stiffness, so that the top curl on the paper cup 114 can be formed without having to fear any buckling or bulging of the upper rim of the paper cup 114. The forming of the top curl is in this way more easily possible in a single step or in a few partial steps than with infeed of the curling tool parallel to the central longitudinal axis of the paper cup 114.

The curling tool 120 thus has, thanks to being split into individual segments 122, 124, a variable diameter of the curling groove. After complete infeed of the segments 122, 124 of the curling tool 129, the segments 122, 124 can be in contact by their side walls and form a closed and full circle of the curling groove. The crucial factor is that infeed of the individual segments 122, 124 takes place approximately parallel to the inclination angle of the upper rim of the paper cup 114, as then the upper rim of the paper cup 114 can project further beyond the holding punch 116 and the holding ring 118 than would be permissible in the case of non-parallel infeed of the curling tool to the upper rim. This is because with a non-parallel infeed of the curling tool, the tendency of the upper area of the paper cup 114 to buckle or bulge during application of the curling tool would be substantially greater than with the parallel infeed of the curling tool 120 shown by the arrow 126 as illustrated in FIG. 24.

The invention claimed is:

1. A paper cup comprising a cup sleeve and a bottom connected in a substantially liquid-tight manner to the cup sleeve, wherein the cup sleeve has a top curl shaped at an end of the cup sleeve opposite the bottom, wherein the cup sleeve is arranged between the bottom and the end of the cup sleeve opposite the bottom at least in some sections at an angle greater than or equal to 10° relative to a central longitudinal axis of the paper cup, and one of the some sections includes a top of the cup sleeve adjacent the top curl; wherein the top curl is pressed flat against an exterior surface of the cup sleeve.

2. The paper cup according to claim 1, wherein the cup sleeve is, between the bottom and the end of the cup sleeve opposite the bottom, curved outwards at least in some sections when viewed from an interior of the cup.

3. The paper cup according to claim 1, wherein the cup sleeve is, between the bottom and the end of the cup sleeve opposite the bottom, curved inwards at least in some sections when viewed from an interior of the cup.

4. The paper cup according to claim 1, wherein the cup sleeve has an S-shaped cross-section so that the cup sleeve is, in an area of the bottom and in an area of the end of the cup sleeve opposite the bottom, at a lower angle relative to the central longitudinal axis than in a central section.

5. The paper cup according to claim 1, wherein the cup sleeve is connected in liquid-tight manner by an all-round edge to the bottom, where the edge is formed by folding a lower rim area of the cup sleeve around a bottom rim, or a lower rim area of the bottom around the lower rim area of the cup sleeve, and wherein the lower rim area of the cup sleeve or the lower rim area of the bottom is provided with notches.

6. The paper cup according to claim 5, wherein the notches extend from the lower rim area of the bottom or from the lower rim area of the cup sleeve to no more than half a height of the edge.

7. The paper cup according to claim 5, wherein the cup sleeve is provided with an all-round recess projecting into an interior of the cup, and a lower rim of the edge is dimensioned such that an outer circumference of the lower rim of the edge is smaller than or equal in size to a larger diameter at the recess and larger than a smaller diameter at the recess.

8. The paper cup according to claim 1, wherein the top curl is curved into a circle.

9. The paper cup according to claim 1, wherein the top of the cup sleeve adjacent the top curl is a continuously smooth surface.

10. The paper cup according to claim 1, wherein the cup sleeve between the top curl and the bottom is a continuously planar surface.

11. The paper cup according to claim 1, wherein the top of the cup sleeve adjacent the top curl is a continuously planar surface.

12. A paper cup comprising:

a substantially frusto-conical shaped cup sleeve; and a bottom connected in a substantially liquid-tight manner to a bottom area of the cup sleeve;

wherein the cup sleeve includes an outwardly folded top edge at a top area of the cup sleeve and an outer wall extending at least in some sections at an angle greater than or equal to 10° relative to a central longitudinal axis of the cup sleeve; and wherein one of the some sections includes the top area of the cup sleeve adjacent the outwardly folded top edge; wherein the outwardly folded top edge is pressed flat against an exterior surface of the cup sleeve.

13. The paper cup according to claim 12, wherein the outwardly folded top edge is curved into a circle.

14. The paper cup according to claim 12, wherein the top area of the cup sleeve adjacent the outwardly folded top edge is a continuously smooth surface.

15. The paper cup according to claim 12, wherein the cup sleeve between the outwardly folded top edge and the bottom is a continuously planar surface.

16. The paper cup according to claim 12, wherein the top area of the cup sleeve adjacent the outwardly folded top edge is a continuously planar surface.

* * * * *